US006513652B1

(12) United States Patent
Solheim et al.

(10) Patent No.: US 6,513,652 B1
(45) Date of Patent: Feb. 4, 2003

(54) GOLF BAG WITH SHOULDER STRAP AND INTEGRAL HANDLE

(75) Inventors: John A. Solheim, Phoenix, AZ (US); Gregory J. Schmidt, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/949,066

(22) Filed: Sep. 7, 2001

(51) Int. Cl.[7] ..... A63B 55/00
(52) U.S. Cl. ..... 206/315.3; 206/315.7
(58) Field of Search ..... 206/315.3, 315.8

(56) References Cited

U.S. PATENT DOCUMENTS

| | | | | | |
|---|---|---|---|---|---|
| 1,607,802 | A | * | 11/1926 | Schank | 206/315.3 |
| 1,607,803 | A | * | 11/1926 | Schank | 206/315.3 |
| 1,727,578 | A | * | 9/1929 | Wengard | 206/315.3 X |
| 2,437,405 | A | * | 3/1948 | Robinson | 206/315.3 X |
| 2,861,614 | A | * | 11/1958 | Kish, Jr. | 206/315.3 |
| 4,767,001 | A | * | 8/1988 | Kim | 206/315.3 |
| 4,834,235 | A | | 5/1989 | Solheim et al. | |
| 4,905,827 | A | * | 3/1990 | Kim | 206/315.3 |
| 5,002,185 | A | * | 3/1991 | Schurman | 206/315.3 X |
| 5,038,984 | A | * | 8/1991 | Izzo | 206/315.3 X |
| 5,096,059 | A | * | 3/1992 | Henderson | 206/315.5 |
| 5,419,473 | A | * | 5/1995 | Lamar | 206/315.3 X |
| 5,437,365 | A | * | 8/1995 | Solheim | 206/315.3 |
| 5,465,839 | A | * | 11/1995 | Gretz | 206/215.3 |
| 5,499,761 | A | * | 3/1996 | Reimers | 206/315.3 X |
| 5,638,954 | A | * | 6/1997 | Hsien | 206/315.8 |
| 5,860,519 | A | * | 1/1999 | Meyer et al. | 206/315.3 |
| 5,954,255 | A | * | 9/1999 | Beebe et al. | 206/315.3 X |
| 6,109,433 | A | * | 8/2000 | Pratt | 206/315.3 X |

* cited by examiner

*Primary Examiner*—Sue A. Weaver
(74) *Attorney, Agent, or Firm*—Darrell F. Marquette

(57) ABSTRACT

A golf bag having a unitary tubular body and a method of making the body are disclosed. The body has a generally ovoid cross sectional shape with a small radius portion of the ovoid shape forming a ridge which extends generally longitudinally of the body. A handle and an upstanding rib extend from the ridge. The rib is provided with a plurality of transverse slots arranged along its length for attachment of a pocket assembly. A protective collar is attached to the body at an open top end thereof, and an upper end of a shoulder strap is coupled to the protective collar. A lower end of the shoulder strap is connected to the body between the handle and the rib.

5 Claims, 5 Drawing Sheets

GOLF BAG WITH SHOULDER STRAP AND INTEGRAL HANDLE

BACKGROUND OF THE INVENTION

This invention relates generally to golf equipment and, in particular, to a golf bag with a shoulder strap and an integral handle.

Lightweight bags for carrying golf clubs such as disclosed in U.S. Pat. No. 4,834,235 to J. A. Solheim and G. J. Schmidt are normally formed with molded top and bottom structures and have a tubular fabric body, which is usually made of nylon, extending between the molded top and bottom structures and attached thereto by sewing. The spacing between the molded top and bottom structures and the shape of the tubular body are established and maintained by longitudinal stays such as wooden or fiber glass dowels contained within sleeves which are sewn inside the body. The stays have their opposite ends engaged with the top and bottom structures.

These lightweight bags, or "carry bags" as they are sometimes called, are provided with suitable pockets for carrying accessories such as golf balls, tees and other equipment with such pockets being normally affixed to the outer surface of the bag body. Also, lightweight bags have a shoulder strap which may be either a single strap for supporting the bag on only one shoulder or a dual shoulder strap for supporting the bag on both shoulders. In addition, lightweight carry bags are often provided with a stand mechanism such as shown in the above-mentioned J. A. Solheim et al patent which supports the bag in a propped-up position when it is set down on the ground so that a golfer does not need to bend over to pick up the bag. Stand mechanisms for golf bags are usually movable between an extended position and a retracted position.

SUMMARY OF THE INVENTION

The present invention provides a golf bag having a generally tubular body with a closed bottom end and an open top end. An upstanding rib is formed integrally on and along one side of the body. The rib extends generally longitudinally of the body from proximate the closed bottom end thereof toward the open top end thereof. Attachment means are provided for connecting a lower end of a shoulder strap to the body, and a protective collar mounted on the open top end of the body includes a strap for coupling an upper end of the shoulder strap thereto. A handle may be formed integrally with and along the same side of the body as the rib in alignment with the rib and proximate the open top end thereof. The body may have a generally ovoid cross sectional shape with a small radius portion of the ovoid shape forming a ridge which extends generally longitudinally of the body. The handle and the rib will extend outwardly from the ridge. The attachment means for connecting the shoulder strap to the body may include an annular groove which is formed in the body between the handle and the rib and an attachment strap on the shoulder strap lower end. This attachment strap is received in the annular groove. The rib provides rigidity to the body and functions to attach a pocket assembly to the body.

DESCRIPTION OF THE PREFERRED EMBODIMENTS

Figure 1:
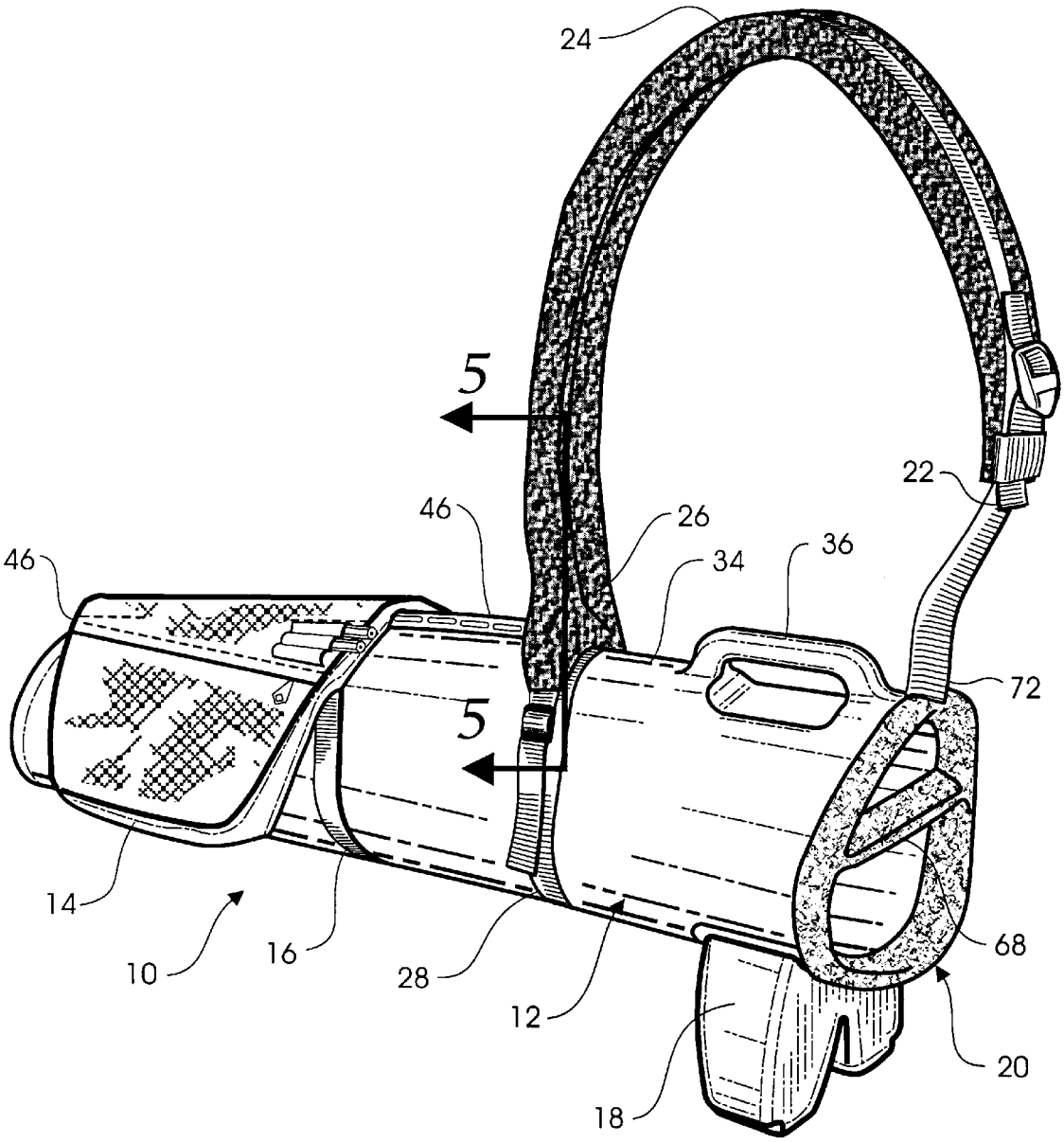
FIG. 1 is a perspective view of a golf bag incorporating a body according to the present invention.

Referring to the drawings, FIG. 1 shows a golf bag incorporating a generally tubular body according to the present invention with the golf bag being indicated generally by the reference numeral 10 and the body being indicated generally by the reference numeral 12. The golf bag 10 includes a pocket assembly 14 for carrying accessories used in playing golf such as golf balls, tees and the like. The pocket assembly 14 is removably attached to the body 12 by suitable straps 16 (only one of which is shown). Also included on the golf bag 10 is a stand 18 for propping up the body 12 so that, whenever the golf bag 10 is resting on the ground, heads of the golf club heads (not shown) carried in the golf bag 10 will not contact the ground. The body 12 has a protective collar 20 attached thereto with the collar 20 having an upper end 22 of a shoulder strap 24 coupled thereto. A lower end 26 of the shoulder strap 24 is attached to the body 12 by an attachment strap 28.

Figure 2:
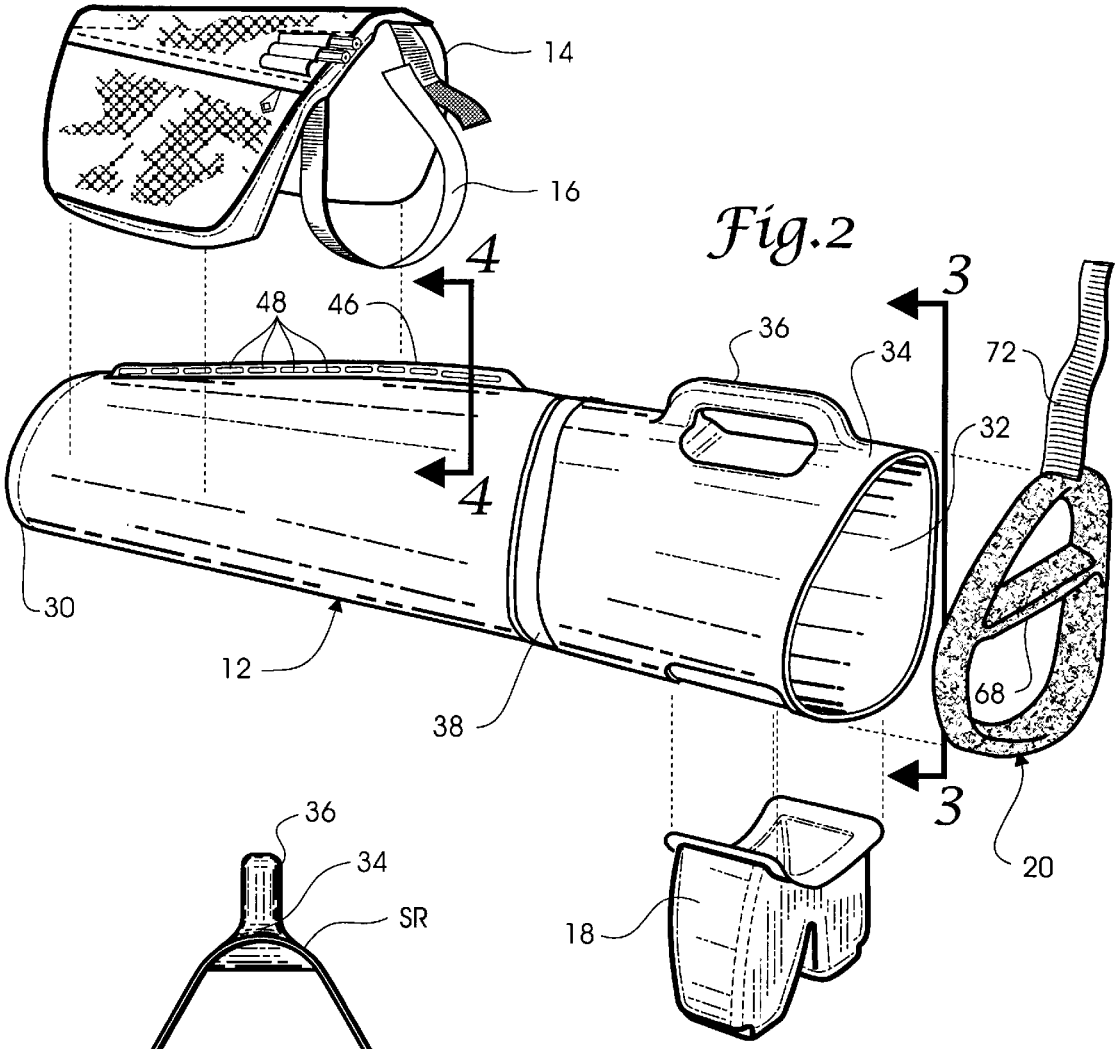
FIG. 2 is a perspective view similar to FIG. 1 with a pocket assembly, a stand and a protective collar removed from the body.
Figure 3:
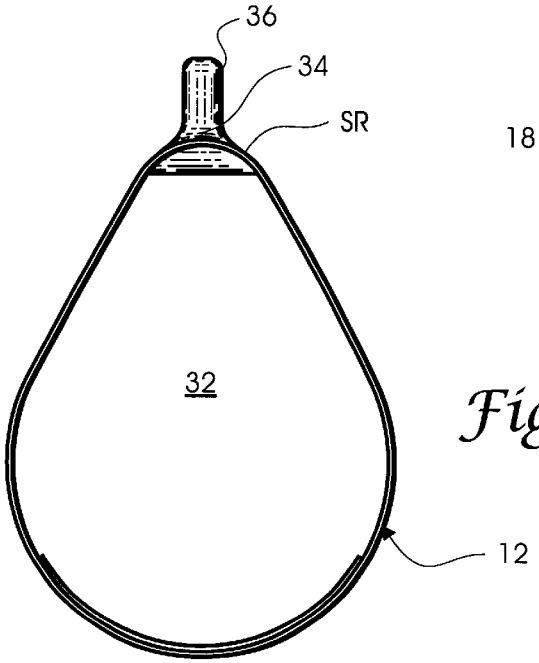
FIG. 3 is an enlarged end view of the body taken along the lines 3—3 in FIG. 2.
Figure 4:
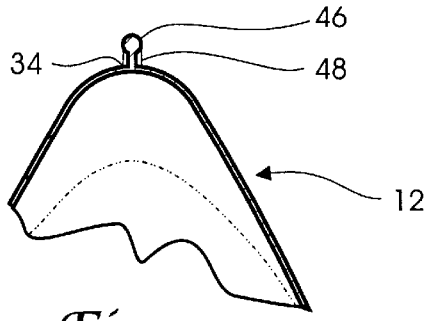
FIG. 4 is an enlarged sectional view of the body taken along the lines 4—4 in FIG. 2.

Referring now also to FIGS. 2, 3, and 4, the body 12 of the present invention is shown. The body 12 is an elongated unitary structure having a closed bottom end 30 and an open top end 32. The body 12 preferably has a generally ovoid cross sectional shape (as best seen in FIG. 3) so that a relatively small radius portion SR of the ovoid shape provides a ridge 34 which extends generally longitudinally of the body 12. A handle 36 is integrally formed on and along one side of the body 12 so as to extend therefrom in a plane which is substantially perpendicular to the longitudinal axis of the body 12. The handle 36 is positioned on the ridge 34 proximate the open top end 32 of the body 12. Attachment means are provided on the body 12 so that the lower end 26 of the shoulder strap 24 may be connected to the body 12. This attachment means includes an annular groove 38 formed in the body 12 and the attachment strap 28 on the lower end 26 of the shoulder strap 24 which is received in the groove 38 to prevent longitudinal movement of the shoulder strap lower end 26 when the shoulder strap 24 is mounted on the body 12 in the manner shown in FIG. 1.

Figure 5:
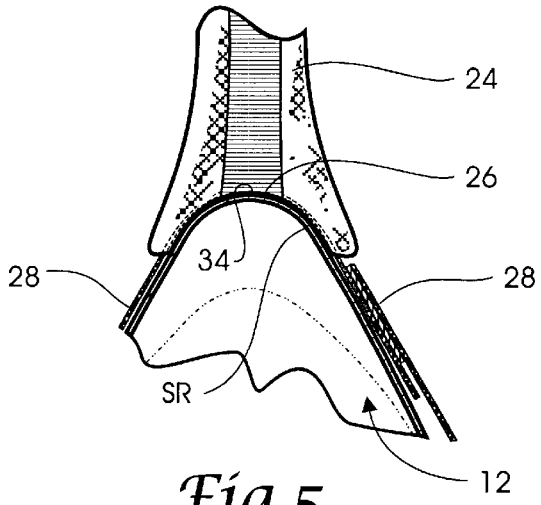
FIG. 5 is an enlarged sectional view of the body taken along the lines 5—5 in FIG. 1 also showing a shoulder strap connected to the body by a connector device.

A connector device is provided on the lower end 26 of the shoulder strap 24 and on the body 12 so that the shoulder strap 24 will extend normally from the body 12 in substantially the same perpendicular plane as the handle 36. When the golf bag 10 is resting on the ground in the propped up position shown in FIG. 1, the shoulder strap 24 will be disposed in an upwardly extending position so that, without bending over, a golfer may pick up the golf bag 10 from the propped up position of FIG. 1. In the connector device of FIG. 5, the shoulder strap 24 has a bifurcated shape on its lower end 26 so that the lower end 26 straddles the ridge 34 on the body 12.

Figure 6:
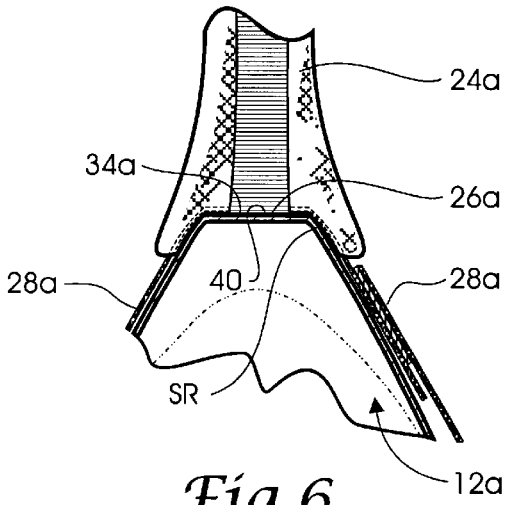
FIG. 6 is an enlarged sectional view similar to FIG. 5 showing another connector device for connecting the shoulder strap to the body.

Another connector device for connecting a shoulder strap 24*a* to a body 12*a* is shown in FIG. 6 wherein the body 12*a* provides a longitudinally extending ridge 34*a* with a flat surface 40 at the apex of the small radius portion SR of the ovoid shape of the body 12*a*. The flat surface 40 may extend the full length of the ridge 34*a* or it may be formed only where a bifurcated lower end 26*a* of a shoulder strap 24*a* is mounted on the body 12*a* by an attachment strap 28*a*.

Figure 7:
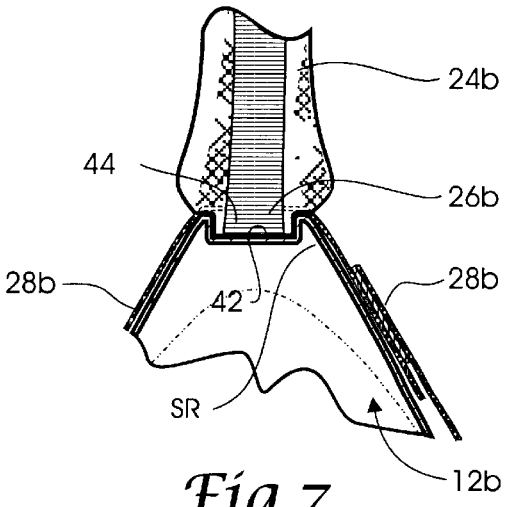
FIG. 7 is an enlarged sectional view similar to FIGS. 5 and 6 showing a further connector device for connecting the shoulder strap to the body.

FIG. 7 shows a further connector device for connecting a shoulder strap 24*b* to a body 12*b* wherein the shoulder strap 24*b* will normally be disposed in a perpendicularly extending position with respect to the body 12*b* for the reasons set forth above. In the connector device of FIG. 7, the body 12*b* can be of any desired cross-sectional shape, such as round, and is provided with a mortise 42 within an annular groove (not shown but similar to annular groove 38) of the body 12*b* where an attachment strap 28*b* attaches the shoulder strap 24*b* to the body 12*b*. A lower end 26*b* of the shoulder strap 24*b* is formed with a tenon 44 which mates with the mortise 42 to form a mortise-tenon joint which holds the shoulder strap 24*b* in the desired upwardly extending position when the golf bag 10 is resting on the ground in its propped up position by utilizing the stand 18.

Referring again to FIG. 2, the body 12 also includes an upstanding rib 46 which extends generally longitudinally of the body 12 from proximate the closed bottom end 30 thereof toward the open top end 32 thereof. The rib 46 is located on the ridge 34 and extends outwardly therefrom. It will be understood that the groove 38 is located between the rib 46 and the handle 36, and the rib 46 is formed integrally on the body 12 along the same side of the body 12 as the handle 36 in alignment with the handle 36. The rib 46 is provided with a plurality of slots 48 along its length which extend transversely through the rib 46. The rib 46 provides rigidity to the body 12 and functions to removably attach the pocket assembly 14 to the body 12 at a plurality of longitudinally selected locations. As mentioned above, the pocket assembly 14 is provided with two straps 16 (only one of which is shown in FIG. 1) with each strap 16 being positioned to pass through one of the slots 48 in the rib 46 and with the straps 16 being secured around the body 12 by suitable hook and loop fasteners (not shown).

Figure 8:
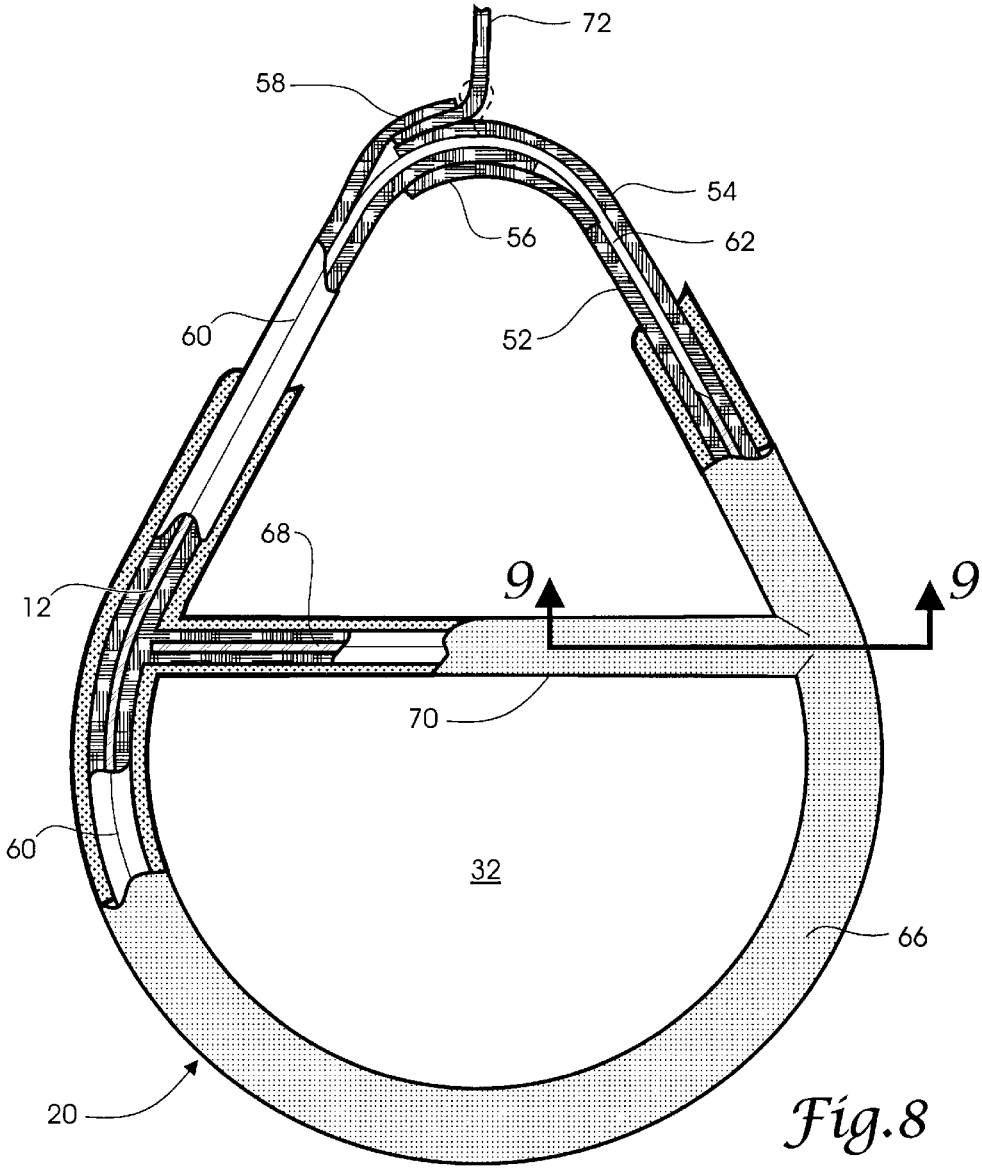
FIG. 8 is an enlarged plan view of the protective collar with portions thereof broken away.
Figure 9:
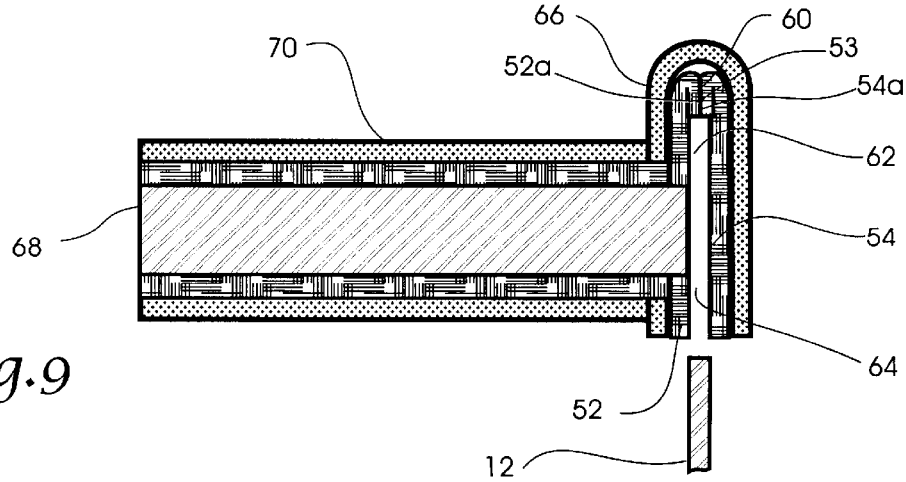
FIG. 9 is an enlarged sectional view taken along the lines 9—9 in FIG. 8.

The protective collar 20, as best seen in FIGS. 8 and 9, has an ovoid shape that matches the ovoid shape of the open top end 32 of the body 12, and it is provided with an inner web 52 and an outer web 54. The opposite ends of the inner web 52 are attached to each other by sewing them together in an overlapped position, as shown at 56 in FIG. 8, to form the web 52 into an endless loop. The opposite ends of the outer web 54 are similarly sewn together at 58, and the two webs 52, 54 are arranged in a concentric relationship with an adjacent pair of their elongated edges 52*a*, 54*a* being stitched together at 53 and with the webs 52, 54 being turned inside out to form a blind seam 60 as seen in FIG. 9. Such attachment of the inner and outer webs 52 and 54 to each other provides an annular space 62 between the webs 52, 54 which is open at 64 for receiving the open top end 32 of the body 12. When the protective collar 20 is mounted on the body 12 in this manner, it is then attached thereto by sewing. In addition to the webs 52 and 54, the collar 20 is provided with a synthetic cover 66 which protects shafts of golf clubs that are carried in the golf bag 10 from abrasive damage. A cross bar 68 has its opposite ends connected to the inner web 52 such as by sewing so that the cross bar 68 spans the open top end 32 of the body 12. The cross bar 68 which is also covered with a synthetic cover 70 provides segregated positioning of golf clubs in the golf bag 10. The protective collar 20 is provided with a coupling strap 72 which extends from the apex of the small radius portion of its ovoid shape for coupling the upper end 22 of the shoulder strap 24 to the protective collar 20 and thus to the body 12.

Figure 10:
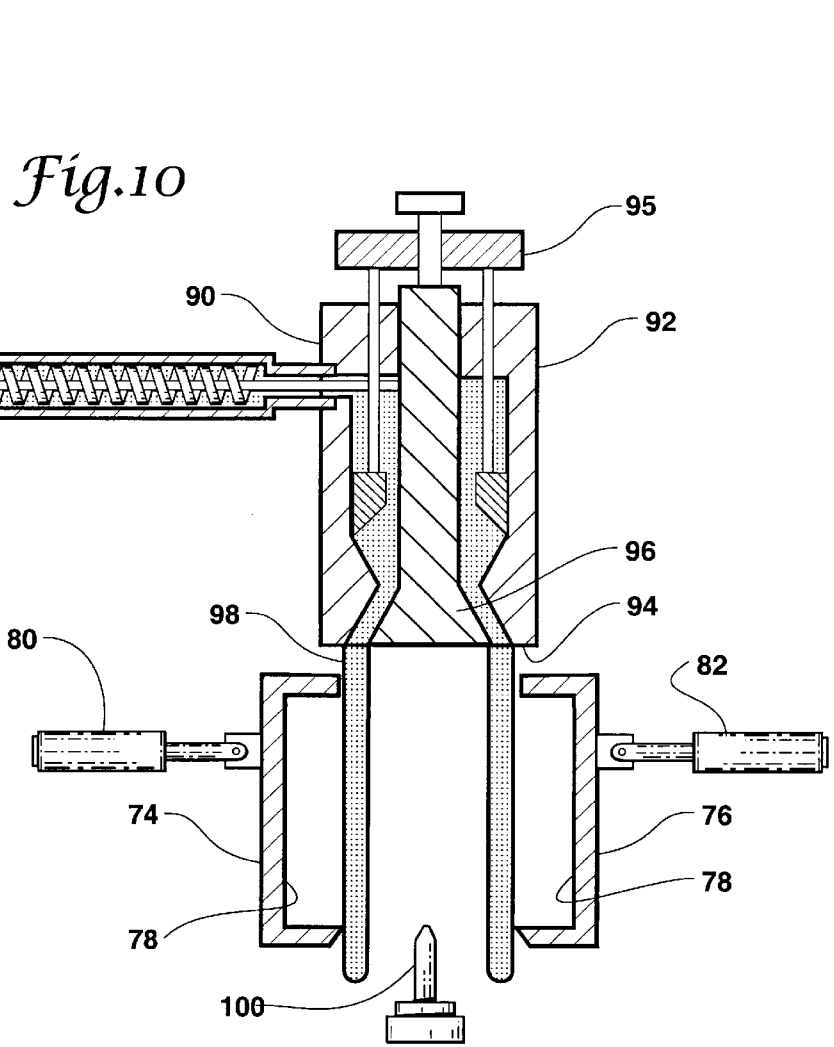
FIG. 10 is a schematic illustration of molding apparatus used in making the golf bag body of the present invention.
Figure 11:
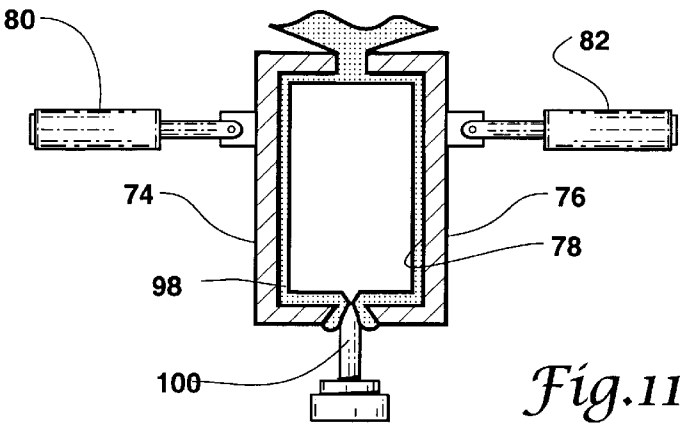
FIG. 11 is a schematic view showing the molding apparatus of FIG. 10 in a closed position.

The golf bag body 12 may be formed by using any suitable molding technique such as injection molding or blow molding with blow molding being preferred. The preferred method of making the golf bag body 12 will now be described with reference being made to the schematic illustrations of FIGS. 10 and 11. The method includes forming a pair of mold halves 74 and 76 with an internal cavity 78 therebetween which conforms to the golf bag body 12, and providing suitable means such as hydraulic cylinders 80 and 82 for moving the mold halves 74, 76 between open and closed positions. A suitable mixture of synthetic resin 84 is supplied to an input end 86 of a screw extruder 88, and the screw extruder 88 is driven to plasticize the resin mixture 84 and deliver it to an input end 90 of a heated accumulator 92 which also has an output end 94. The mold halves 74, 76 are located adjacent the output end 94 of the accumulator 92 while the mold halves 74, 76 are in their open position. The accumulator 92 has a cylindrical pushing mechanism 95 therein which pushes the heated resin mixture through a die 96 provided in the accumulator 92 to shape the resin mixture into a tubular body 98 which exits the output end 94 of the accumulator 92 and enters the internal cavity 78 between the mold halves 74, 76. The mold halves 74, 76 are then moved into their closed position (FIG. 11) which seals the opposite ends of the generally tubular body 98, and air under pressure is then blown through an injector pin 100 into the tubular body 98 to force it into conformity with the cavity 78 of the mold halves 74, 76. Finally, the mold halves 74, 76 are cooled and moved to their open position so the tubular body 98 may be removed therefrom. An upper end of the tubular body 98 is cut off to complete the golf bag body 12.

What is claimed is:

1. A golf bag comprising:

a generally tubular body having a closed bottom end and an open top end;

an upstanding rib on said body, said rib extending generally longitudinally of said body from proximate the closed bottom end thereof toward the open top end thereof;

said rib being formed integrally on and along one side of said body;

a handle formed integrally on and along said one side of said body in alignment with said rib and proximate the open top end of said body;

said body having an ovoid cross sectional shape with a small radius portion of the ovoid shape forming a ridge which extends longitudinally of said body, said handle and said rib extending outwardly from said ridge;

said body having an annular groove formed therein intermediate said rib and said handle for receiving an attachment strap which connects a lower end of a shoulder strap to said body with the lower end of the shoulder strap being in engagement with said ridge; and a protective collar mounted on the open top end of the body, said protective collar having a strap extending therefrom for coupling an upper end of the shoulder strap thereto.

2. The golf bag of claim 1, wherein said body is formed by utilizing a blow molding process.

3. A golf bag comprising:

a generally tubular body having a closed bottom end and an open top end;

an upstanding rib on said body, said rib extending generally longitudinally of said body from proximate the closed bottom end thereof toward the open top end thereof;

attachment means for connecting a lower end of a shoulder strap to said body;

said attachment means including an annular groove formed in said body; and said attachment means also including an attachment strap on the shoulder strap lower end, said attachment strap being received in said annular groove.

4. A golf bag comprising:

a generally tubular body having a closed bottom end and an open top end;

a handle formed integrally on and along one side of said body proximate the open top end thereof;

an upstanding rib formed integrally on and along said one side of said body in alignment with said handle, said rib extending generally longitudinally of said body from proximate the closed bottom end thereof toward the open top end thereof;

said body including an annular groove formed therein between said handle and said rib; and a shoulder strap having a lower end connected to said body by an attachment strap which is received in said annular groove.

5. The golf bag of claim 4, further comprising a protective collar on the open top end of said body, and wherein said shoulder strap has an upper end coupled to said protective collar.

* * * * *